United States Patent [19]

George

[11] Patent Number: 5,050,679

[45] Date of Patent: Sep. 24, 1991

[54] METHOD OF SEALING CONTAMINATED WELLS

[76] Inventor: Leroy George, 15627 West Grand Ave., Surprise, Ariz. 85374

[21] Appl. No.: 583,491

[22] Filed: Sep. 17, 1990

[51] Int. Cl.[5] ..... E03B 3/12

[52] U.S. Cl. ..... 166/285; 166/387; 175/402

[58] Field of Search ..... 166/285, 387, 295, 290, 166/380; 175/402, 403

[56] References Cited

U.S. PATENT DOCUMENTS

| | | | |
|---|---|---|---|
| 1,153,811 | 9/1915 | Montgomery | 175/402 |
| 1,269,090 | 6/1918 | Kistler | 166/285 |
| 2,173,033 | 9/1939 | Armentrout et al. | 166/285 |
| 2,349,181 | 5/1944 | Lerch et al. | 166/295 |
| 3,013,608 | 12/1961 | Church | 166/285 X |
| 4,675,441 | 4/1987 | Horvath | 175/402 X |
| 4,687,060 | 8/1987 | Richards et al. | 166/285 |

*Primary Examiner*—Stephen J. Novosad
*Attorney, Agent, or Firm*—Gregory J. Nelson

[57] ABSTRACT

A method for sealing a well to prevent ground water contamination in which the existing perforate casing is at least temporarily intermally capped. Thereafter, a new imporforate casing is palaced about a portion of the length of the existing casing extending to a predetermined depth. Sealant is injected between the casings to seal-off at least a portion of the existing casing. If the well is to be activated, a collar, pump and access piping are installed.

11 Claims, 2 Drawing Sheets

METHOD OF SEALING CONTAMINATED WELLS

The present invention relates to a method of treating cased water wells to reduce or prevent the infiltration of contaminants into the well column and water table.

Water wells for providing a water supply are generally constructed by drilling or boring a hole in the ground extending from the surface into the water-bearing stratrum or aquafier. To support the bore and prevent collapse of the bore, a generally cylindrical casing is inserted into the bore extending into the aquafier. The casing extends from the aquafier to above grade where the casing terminates and is covered by a sanitary cap. This structure is generally termed the well column. Generally the well casing is provided with perforations or holes randomly placed through the casing lining to facilitate passage of ground water into the well shaft. The purpose of the perforations is to allow ground water to add to the well supply.

The land surface surrounding the well column is one of the largest sources of contaminants to the water supply. Toxic substances such as fertilizers, industrial waste, petroleum products and various other contaminants are often found or disposed on the land surface. Surface water percolates by the line of least resistance and will migrate along settling fractures towards the well column. The percolation process also carries the contaminants with it. The contaminated surface water from settling fractures and from the perched water table enters the well column seeping through the gravel pack and the well column liner perforations. The introduction of the contaminated water into the well column will pollute the water table or aquifer. Accordingly, ground water found near the surface and rain water often serve as carriers for the contaminants polluting ground water supplies.

To deal with this problem, several solutions can be found in the prior art. One approach is to include a concrete pad surrounding the well casing extending a substantial distance in all directions from the casing. A typical concrete pad will have an upper surface which is sloped away from the casing so that rain water, surface water containing contaminants will be drained away from the well casing.

Other methods of shielding wells from contamination utilize some type of impervious flexible skirt which may be placed around the well to deflect water away from the well casing. While such arrangements may work well in some instances, contaminant carrying surface water can still find its way beneath these skirts through the soil and along fractures to the well to contaminate the well.

Accordingly, there exists a need in the prior art for effectively reclaiming or rehabilitating wells in situ to prevent or minimize ground water contamination in the manner described above.

The present invention provides a method in which wells which have been capped or closed due to contamination can be reclaimed or rehabilitated and which will effectively seal abandoned wells. Briefly, the method of sealing a cased contaminated well involves placing protective interior caps in the well casing at a predetermined location at a position above the static water table and below the tight clay layer. A second interior cap is placed below the top of the lining lid. A new imperforate casing is inserted around the original well column casing extending through the perched water table and tight clay areas. The new casing is drilled into position with the lower edge of the casing being provided with an appropriate cutting edge or teeth. When the new casing is in position, a suitable plastic sealant or cementitious material is injected between the casings so that the material will flow along the outside of the new casing and also into the annular space between the old and new casings.

Once the new casing is in place and the sealant cured, a concrete collar is placed around the outside diameter of the new well column which will support a steel well covering. If the well is an abandoned well, the interior caps are left in place. If the well is an active well, the well is cleaned out and a pumping motor is installed with an access pipe for water which passes through the reinforced steel well cover. The present invention effectively seals-off the upper portion of the foraminous casing above the tight clay layer to prevent infiltration or invasion of the upper casing by contaminated surface water.

The above and other objects of the present invention will be better understood from the following description taken in conjunction with the drawings in which.

Figure 5:
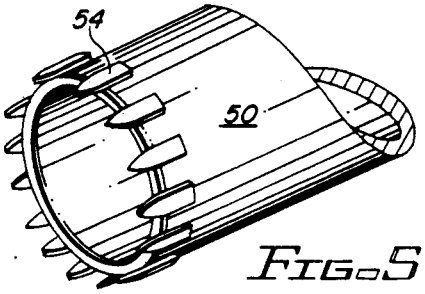

FIGS. 4A to 4F schematically illustrate the steps involved in sealing, wells according to the invention; and FIG. 5 is a perspective view of the lower end of the new casing to be installed.

Figure 1:
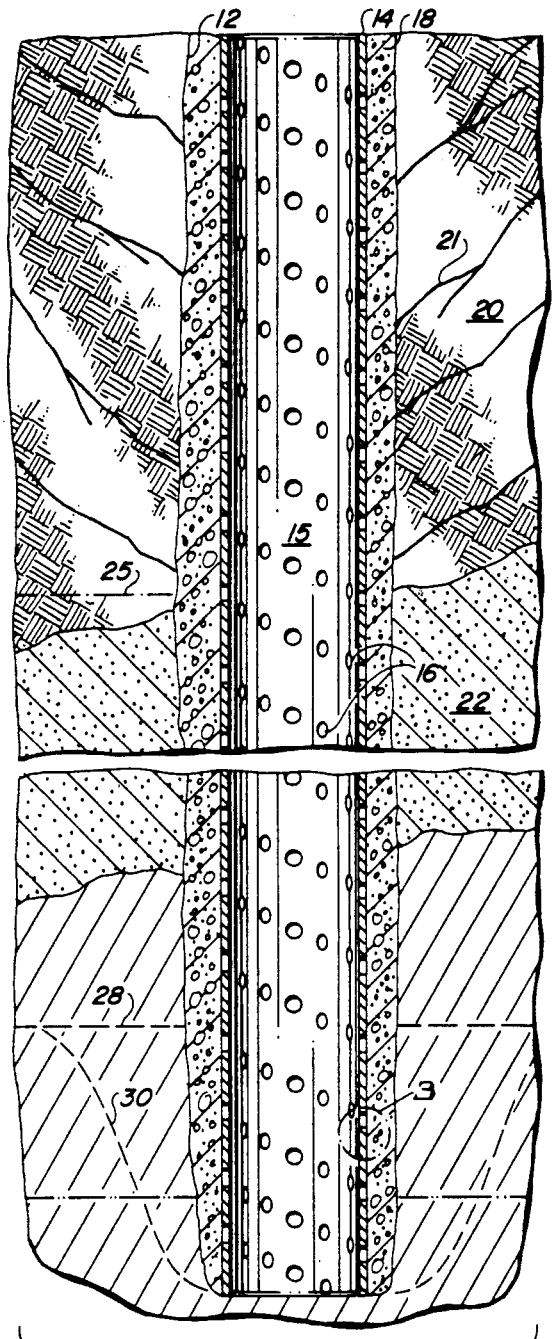
FIG. 1 is a cross sectional view of a typical water well.
Figure 3:
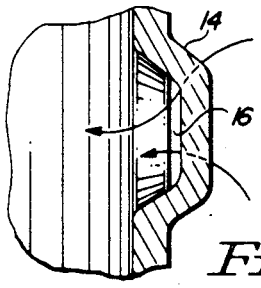
FIG. 3 is a detail view of casing perforations as indicated in FIG. 1.

Referring to FIGS. 1 and 3, a typical cased water well is shown. The well location is representative of geological formations having a land surface into which a bore 12 extends. The bore 12 is peripherally defined by a pipe or casing 14 having a plurality of perforations 16 which are randomly placed through the casing to facilitate passage of ground water to the well shaft. The casing defines a well shaft 15 which is representative of many existing water wells in which the perforations 16 extend substantially the entire length of the casing having been punched into the casing as shown in detail in FIG. 3.

Conventionally gravel pack 18 consisting of gravel having various size, typically from $\frac{1}{8}''$ diameter to $\frac{5}{8}''$ diameter, is placed between the well shaft bore and the well casing. This material prevents lateral movement of the well casing and stabilizes the casing as well as allowing the ground water to seep into the well shaft. The entire well assembly is sometimes referred to as the well column.

The well column extends through an upper strata 20 which in many locations such as in the Southwestern United States may include settling fractures 21. These are stress relief lines due to release of tension imposed on the surrounding area by the initial drilling of the well shaft. Stress relief lines also are created as a result of imperceptible amounts of settling by reduction of the perched water table. Below the upper ground strata is the tight clay layer 22. This is a natural phenomena, again one which occurs particularly in the Southwest, which prohibits penetration of percolated surface water. A perched water table 25 accumulates above the tight clay layer. In the past, when contamination and environmental problems were not such a major concern, it was desirable to collect this water and add the water to the well supply so the perched water table was allowed to enter into the well column through the perforations at this elevation in the liner.

The static water table level 28 exists below the tight clay layer. This is the water table that is normally impervious to percolated water from the land surface surrounding the well column. When the well is operated, water will migrate in a general pattern as indicated by numeral 30 to the bottom of the well column to be pumped to the surface.

The land surface 32 surrounding the well column is a major contributor to the source of contaminants to conventional well columns as described with reference to FIG. 1. Contaminants such as fertilizers, chemicals, petroleum products and other ground water contaminants collect or penetrate the surface 32. Surface water will percolate via the path of least resistance and will migrate along the settling fractures 21 toward the well column. The percolation process also carries contaminated water along with it to the perched water table 25. Contaminated surface water from the settling fractures and perched water table then flow into the well casing. The water seeps through the gravel pack 18 and through the well casing perforations 16. The introduction of the contaminated water into the well column pollutes the aquifer. Because of this contamination, many older wells such as that constructed as shown in FIG. 1, must be capped and closed. With the present invention, such wells can either be sealed to prevent further polution or can be reclaimed or rehabilitated. The sealing process of the invention prevents the migration and invasion of upper level water and accompanying contaminants into the well column structure.

Figure 4A:
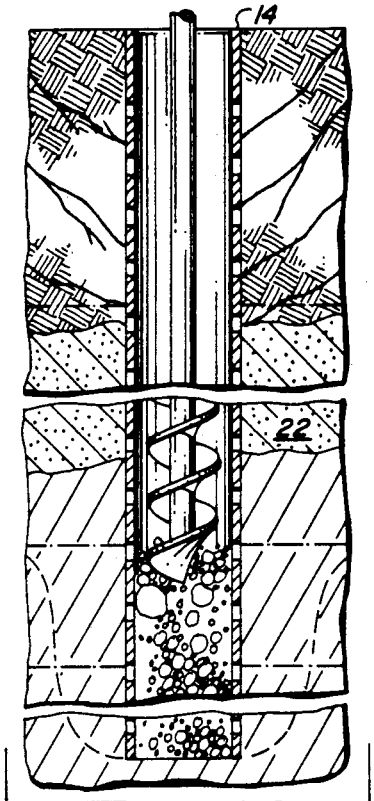
Figure 4B:
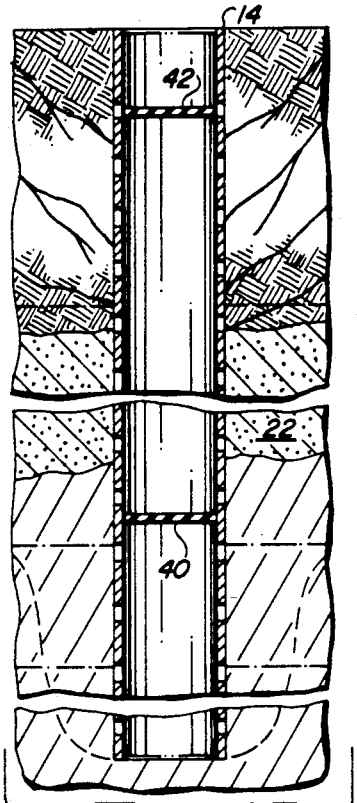

In accordance with the method of the present invention, a well such as that shown in FIG. 1 is sealed by first clearing the well of any and all debris which can be manually extracted or if considerable debris has been accumulated, the structure can be drilled or bored, as seen in FIG. 4A. Once the shaft 15 has been cleared, a first protective cap 40 is secured within the existing casing 14 at a position above the static water table and below the tight clay layer. The proper positioning of the cap or plug 40 may be determined by conventional logging techniques. The cap is preferably a semi-rigid material such as a hard rubber or plastic which serves to seal the interior of the existing well casing while positioning a new casing about the existing casing. A second cap 42 is also secured within the existing casing slightly below the top of the casing lip. The caps can be secured in place by any suitable means. The upper cap may be welded in place and the lower cap forced into position and sealed by placing cement or other sealant over the cap. FIG. 4B shows the caps in place.

Figure 4C:
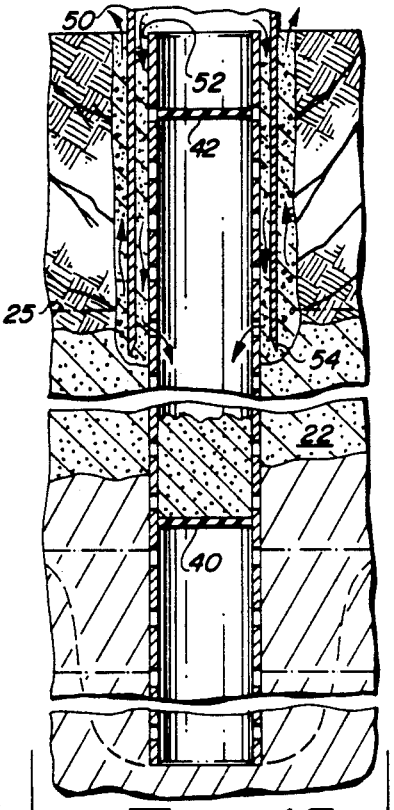

A new imperforate casing or liner 50 is positioned around the existing well ccasing 14, as seen in FIG. 4C. The new casing 50 is generally cylindrical conforming in shape to the existing liner and is slightly larger in diameter so an annulus 52 exists between the casing. The new casing is preferably drilled into position with a boring rig. The lower edge of the casing has an appropriate cutting edge 54 to assist in advancing the casing in position. The cutting edge may be a removable collar having teeth or, as shown in FIG. 5, carbide teeth 54 may be brazed to the lower edge of the casing. Material removal is assisted by pumping a water based slurry or drilling "mud" between the exterior of the old casing and the interior of the new casing. The slurry is forced down between the casings and around the leading edge of the new liner as the new casing is drilled into position. The slurry will return to the surface 32 where gravel may be removed from the slurry and discarded. The slurry may be reclaimed and re-used. Some material may infiltrate the upper well structure but is prevented from contaminating the water supply by cap 40.

The desired depth of the new casing 50 is determined by constantly testing samples from the drilling. Sampling in this manner ascertains the point at which the new casing has passed through the perched water table 25 and the tight clay area 22. After the new casing 50 has passed through the tight clay area, the casing is drilled in position a predetermined distance below the tight clay area. For most tight clay formations, this would be 300 to 44 feet below the surface. This distance may be calculated from sonar measuring or soil sampling.

Figure 4D:
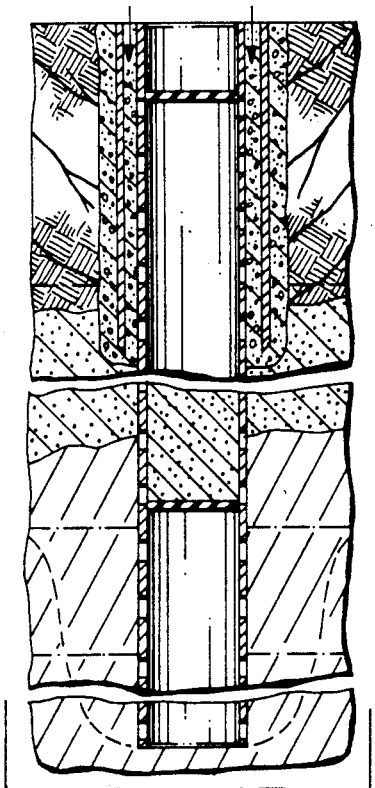
Figure 4E:
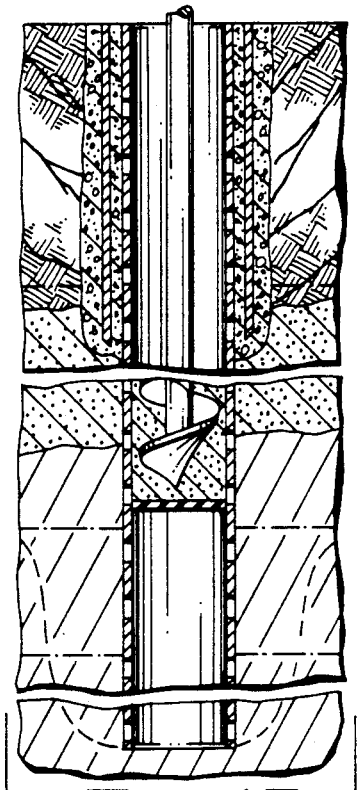
Figure 4F:
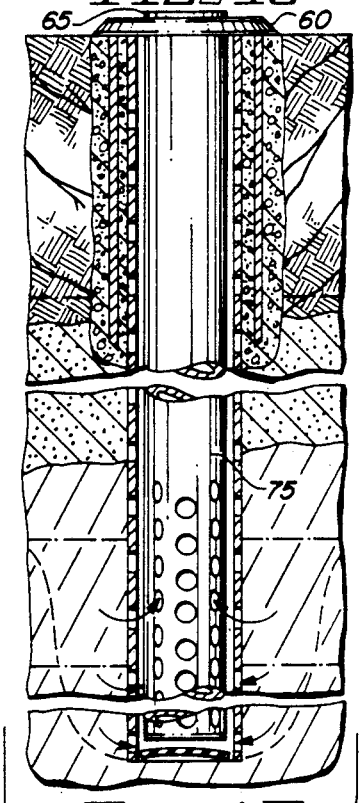

With the new casing in position, introduction of a sealant in the annulus between the casing is initiated, as seen in FIG. 4D. The new casing 50 is imperforate and serves as a barrier to protect the well from contamination. The sealant adds additional protection against contamination. The sealant may be a cementitious material or water-soluble polymeric material which will polymerize or gel when in position to form an elastomeric or rubber-like material which will adhere to and stabilize the casings and serve to plug the openings 16 in the inner, existing casings.

The introduction of the sealant is preferably accomplished by pumping the sealant into the annulus between the casings. The sealant will have sufficient elasticity and fluidity to allow high pressure pumping. The pumping of the sealant is continued until the entire annulus between the casings is filled. Continued pumping after this point forces the plasticized sealant around the bottom edge of the new casing 50 and up along the outer surface of the new casing to the ground level as the sealant material will seek the path of least resistance.

The sealant will also conform to irregularities in the earthen wall of the bore surrounding the well column. Once the sealing operation is completed, an appropriate curing time is generally required to ensure permanent water-tight barrier. Typically a curing time is between 24 to 72 hours for most cementitious or elastomeric materials of this type If the well is not to be reused it may be left in this condition.

Well rennovation for re-use is completed by bailing out the upper well structure to remove debris that may have entered during placement of the new casing. See FIG. 4E. A circular concerte collar 60 may be poured in place around the outside diameter of the new well column liner. Generally when the circular collar is formed it is poured in place with sufficient reinforcing and will be sufficient strength to support pipe stands and the positioning of a reinforced removable steel well cover 65.

The reclamation of the well is completed by removing the caps 40 and 42 and installing a new pumping motor to one side of the well column. Positioning the motor adjacent the well reduces the possibility of contamination of the well from pump lubricants and fuels. The motor has its suction side in communication with the subterranean aquafier by means of new suction pipe 75 which passes through the reinforced steel well cover 60 and depends into the aquafier. Openings for the access pipes in the well cover are preferably sealed.

Figure 2:
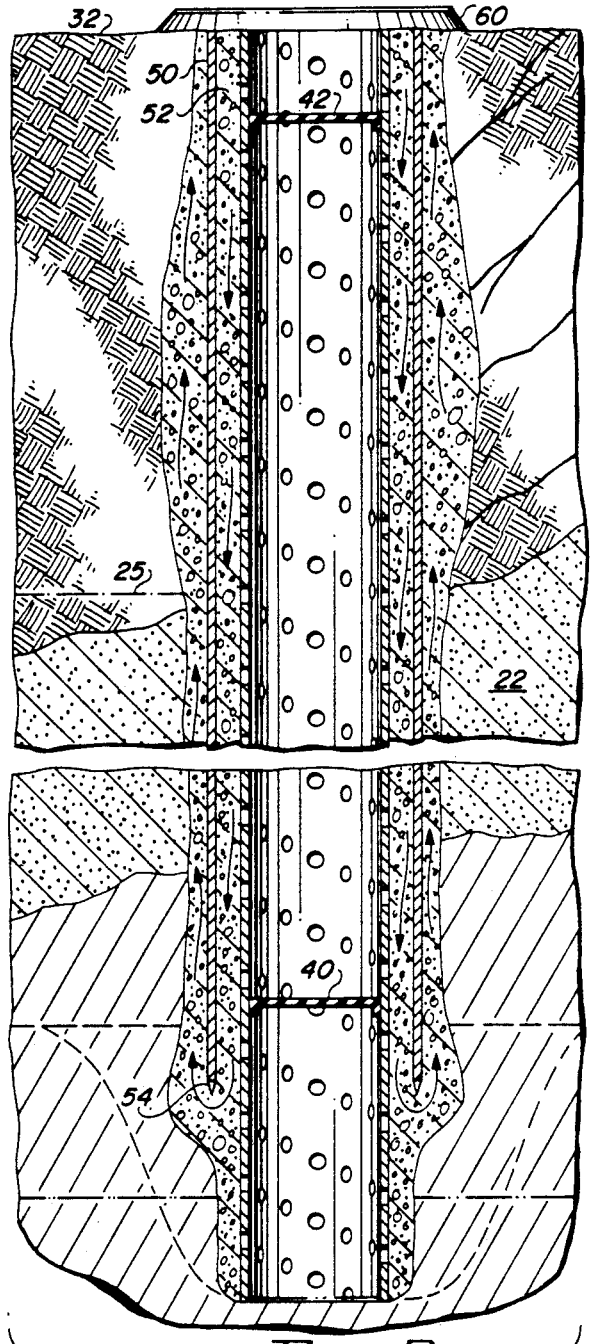
FIG. 2 is a cross-sectional view of a well sealed in accordance with the present invention.

If the well is an abandoned well, the caps 40 and 42 may be left in place and the upper end of the well securely sealed by a cement cap 60 as seen in FIG. 2.

It is thus seen that the present invention provides a method for economically and effectively sealing existing wells in areas where pollutants and contaminants can enter the existing foraminous well liner through upper strata The sealed well is sealed off in the upper strata area to prevent entry of these contaminants and pollutants and the resulting structure is a stabilized cased water well The method has application to new, as well as existing wells. Wells otherwise unsuitable for use may be reclaimed. Once a well has been rehabilitated in the manner described, pumping commences and testing of the well water conducted until the pollution levels are acceptable for the intended use.

It will be obvious to those skilled in the art to make various changes, alterations and modifications to the method of reclaiming contaminated wells as described herein. To the extent such changes, alterations and modifications do not depart from the spirit and scope of the appended claims, they are intended to be encompassed therein.

I claim:

1. A method of in situ treatment of wells having a first perforated casing extending to an aquifer through a subterranean layer that inhibits percolation of surface water, said method comprising:

(a) positioning a second generally cylindrical imperforate well casing about the first well casing, said second well casing depending a predetermined depth to at least said layer and defining an annulus between the outer diameter of the first casing and inner diameter of the second casing; and (b) filling the annulus with a sealant to seal the perforations in the first casing along an upper portion of the first casing to form a barrier to the entry of surface water into the well through the said upper portion of the well structure.

2. The method of claim 1 wherein said subterranean layer is a tight clay layer.

3. The method of claim 1 wherein said first well casing is initially cleared of existing debris.

4. The method of claim 1 wherein protective members are positioned within the interior of the first casing to seal the interior of the first casing while placing the second casing in position.

5. The method of claim 1 wherein said second casing is drilled into position about said first casing, said second casing having a cutting edge provided thereon.

6. The method of claim 1 wherein displaced material is removed as said second casing is put in position.

7. The method of claim 6 wherein said material is removed by pumping a water-based slurry along said casings.

8. The method of claim 1 wherein said sealant is a cementitious material.

9. The method of claim 1 wherein said sealant includes a polymeric material.

10. The method of claim 1 further including the steps of placing a collar about the upper end of said second casing.

11. The method of claim 1 including the steps of placing a cover on said collar and positioning a pump adjacent said well structure having access pipes extending within said first casing to said aquafire.

* * * * *